US007700890B2

(12) United States Patent
Chen

(10) Patent No.: US 7,700,890 B2
(45) Date of Patent: Apr. 20, 2010

(54) KEY DOME ASSEMBLY WITH IMPROVED TACTILE FEEDBACK

(75) Inventor: Chao Chen, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

(21) Appl. No.: 12/014,301

(22) Filed: Jan. 15, 2008

(65) Prior Publication Data

US 2009/0178911 A1 Jul. 16, 2009

(51) Int. Cl.
*H01H 5/18* (2006.01)

(52) U.S. Cl. ..... 200/406; 200/516

(58) Field of Classification Search ..... 200/406, 200/513, 516
See application file for complete search history.

(56) References Cited

U.S. PATENT DOCUMENTS

| | | | | |
|---|---|---|---|---|
| 3,796,843 | A * | 3/1974 | Durkee et al. | 200/5 A |
| 3,941,964 | A * | 3/1976 | Yoder | 200/516 |
| 3,967,084 | A | 6/1976 | Pounds | |
| RE29,440 | E * | 10/1977 | Durkee et al. | 200/5 A |
| 4,083,100 | A | 4/1978 | Flint et al. | |
| 4,084,071 | A * | 4/1978 | Smith | 200/5 A |
| 4,127,752 | A * | 11/1978 | Lowthorp | 200/5 A |
| 4,194,105 | A | 3/1980 | Hodges | |
| 4,343,973 | A | 8/1982 | Main | |
| 4,390,765 | A | 6/1983 | Sado et al. | |
| 4,400,596 | A | 8/1983 | Fukukura et al. | |
| 4,423,294 | A | 12/1983 | Walser et al. | |
| 4,463,232 | A | 7/1984 | Takakuwa | |
| 4,497,982 | A | 2/1985 | Michalski | |
| 4,611,261 | A | 9/1986 | Suwa | |
| 4,703,139 | A | 10/1987 | Dunlap | |
| 4,743,722 | A | 5/1988 | Oelsch | |
| 4,933,522 | A | 6/1990 | Celander | |
| 4,952,761 | A | 8/1990 | Viebrantz | |
| 4,978,818 | A | 12/1990 | Rothlin | |
| 5,422,447 | A | 6/1995 | Spence | |
| 5,513,078 | A * | 4/1996 | Komrska et al. | 361/816 |
| 5,881,866 | A * | 3/1999 | Miyajima et al. | 200/513 |
| 6,501,036 | B2 | 12/2002 | Rochon et al. | |
| 6,603,086 | B2 | 8/2003 | Kawaguchi et al. | |

FOREIGN PATENT DOCUMENTS

| | | |
|---|---|---|
| FR | 2442502 | 6/1980 |
| WO | WO 2005045867 A1 * | 5/2005 |

* cited by examiner

*Primary Examiner*—Michael A Friedhofer
*Assistant Examiner*—Lheiren Mae A Anglo
(74) *Attorney, Agent, or Firm*—Eckert Seamans Cherin & Mellott, LLC; Stephen A. Bucchianeri, Esq.; Brij K. Agarwal, Esq.

(57) ABSTRACT

A dome assembly for use in a keyboard assembly of an electronic device is provided. The dome assembly includes a deflectable dome shaped element having a concave surface terminating at a periphery and a number of elevating members disposed on the element adjacent the periphery and protruding away from the concave surface. The elevating members serve to space the periphery from a mounting surface. The element is movable between an undeflected position and a deflected position.

20 Claims, 6 Drawing Sheets

KEY DOME ASSEMBLY WITH IMPROVED TACTILE FEEDBACK

BACKGROUND

1. Field

The disclosed and claimed concept relates generally to handheld electronic devices and, more particularly, to a key dome assembly for a handheld electronic device, wherein the dome assembly includes micro structures which elevate the dome shaped element from a supporting surface.

2. Description of the Related Art

Numerous types of handheld electronic devices are known. Examples of such handheld electronic devices include, for instance, personal data assistants (PDAs), handheld computers, two-way pagers, cellular telephones, and the like. Many handheld electronic devices also feature a wireless communication capability, although many such handheld electronic devices are stand-alone devices that are functional without communication with other devices.

Such handheld electronic devices are generally intended to be portable, with many of such devices being small enough to fit within, for example, a pocket, a belt holster, a briefcase, or a purse. As the form factor of such devices has shrunk for improved portability, so has the size of components such as keyboards or keypads. The keyboards or keypads include keys that act as switches for input entry when actuated. In furtherance of miniaturization of keyboard assemblies such as keyboards and keypads, one general approach implemented by several different manufacturers has involved the use of an electrical key in the form of a resilient dome shaped element that is electrically conductive and is disposed on a circuit board.

In simplest form, such a dome assembly is a smooth sector of a hollow sphere. When an actuation force is applied to the apex of the dome assembly, the dome assembly collapses, completing an electrical circuit or at least an open portion of an electrical circuit of the device. The collapsing dome assembly provides a tactile feedback to the user of the handheld electronic device. Such simple sphere segments have been generally effective for their intended purpose; however they have not been without limitation, as the tactile feedback is sometimes not noticeable by the user, particularly in miniaturized keyboard assemblies.

Accordingly, it is desirable to manufacture a dome assembly which produces a detectable tactile feedback when electrical contact is made.

BRIEF DESCRIPTION OF THE DRAWINGS

A full understanding of the disclosed and claimed concept can be gained from the following Description when read in conjunction with the accompanying drawings in which:

Similar reference numerals refer to similar parts throughout the specification.

DESCRIPTION

Figure 1:
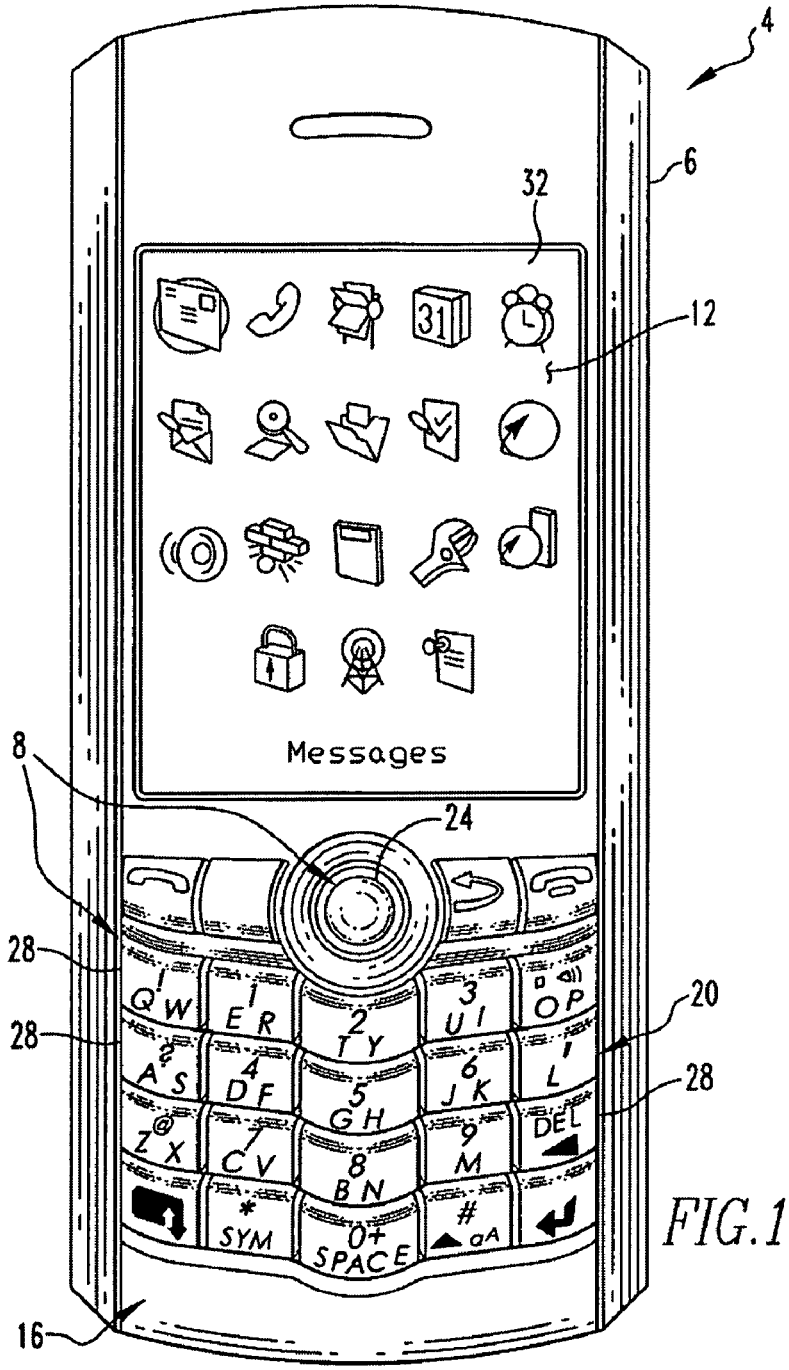
FIG. 1 is a front elevational view of an example handheld electronic device in accordance with the disclosed and claimed concept.
Figure 2:
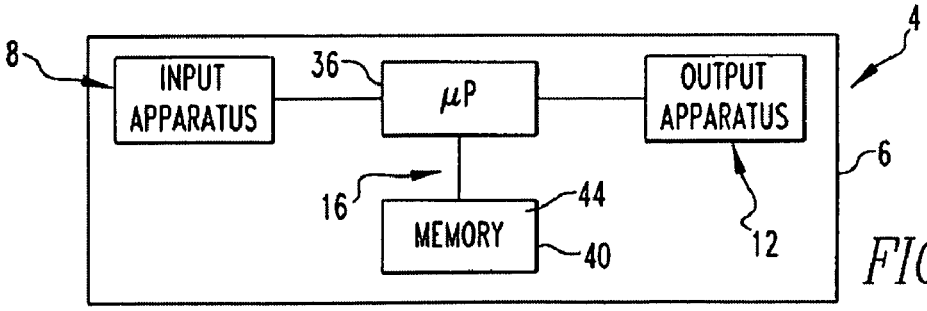
FIG. 2 is a schematic depiction of the example handheld electronic device of FIG. 1.

An improved handheld electronic device 4 in accordance with the disclosed and claimed concept is indicated generally in FIG. 1 and is depicted schematically in FIG. 2. The improved handheld electronic device 4 comprises a housing 6, and further comprises an input apparatus 8, an output apparatus 12, and a processor apparatus 16 disposed on the housing 6. The input apparatus 8 provides input to the processor apparatus 16. The processor apparatus 16 provides output signals to the output apparatus 12.

The input apparatus 8 comprises a keypad 20 and a track ball 24. The keypad 20 in the example embodiment depicted herein comprises a plurality of keys 26 that are each actuatable to provide input to the processor apparatus 16. The track ball 24 is rotatable to provide navigational and other input to the processor apparatus 16, and additionally is translatable in a direction inwardly toward the handheld electronic device 4 to provide other input, such as selection inputs. The track ball 24 is freely rotatable on the housing 6 and thus is able to provide navigational inputs in the vertical direction, i.e., the up-down direction, in the horizontal direction, i.e., the left-right direction, as well as combinations thereof. The keys 26 and the track ball 24 serve as input members which are actuatable to provide input to the processor apparatus 16. The example output apparatus 12 comprises a display 32.

As shown in FIG. 1, many of the keys 26 have a plurality of letters, i.e., linguistic elements, assigned thereto. For instance, one of the keys 26 has assigned thereto the letters "A" and "S". Another of the keys 26 has assigned thereto the letters "Q" and "w". The letters of the example keypad 20 are in an arrangement of a reduced QWERTY keyboard. It is to be appreciated that although the example device shown in FIG. 1 utilizes a reduced keypad 20, the disclosed and claimed concept may readily be employed in other applications, such as but not limited to, a regular (non-reduced) keypad or other combination of one or more individual keys either integral to an electronic device or part of a separate keyboard assembly external to an electronic device.

Examples of other input members not expressly depicted herein would include, for instance, a mouse or track wheel for providing navigational inputs, such as could be reflected by movement of a cursor on the display 32, and other inputs such as selection inputs. Still other example input members would include a touch-sensitive display, a stylus pen for making menu input selections on a touch-sensitive display displaying menu options and/or soft buttons of a graphical user interface (GUI), hard buttons disposed on the housing 6 of the handheld electronic device 4, and so on. Examples of other output devices would include a touch-sensitive display, an audio speaker, and so on.

The processor apparatus 16 comprises a processor 36 and a memory 40. The processor 36 may be, for example and without limitation, a microprocessor (μP) that interfaces with the memory 40. The memory 40 can be any one or more of a variety of types of internal and/or external storage media such as, without limitation, RAM, ROM, EPROM(s), EEPROM (s), FLASH, and the like that provide a storage register, i.e., a machine readable medium, for data storage such as in the fashion of an internal storage area of a computer, and can be volatile memory or nonvolatile memory. The memory 40 has stored therein a number of routines 44 that are executable on the processor 36. As employed herein, the expression "a number of" and variations thereof shall refer broadly to any nonzero quantity, including a quantity of one. One of the routines 44 is a disambiguation routine that is operable to disambiguate ambiguous text input, such as when one of the keys 26 having a plurality of letters assigned thereto is actuated.

Figure 3:
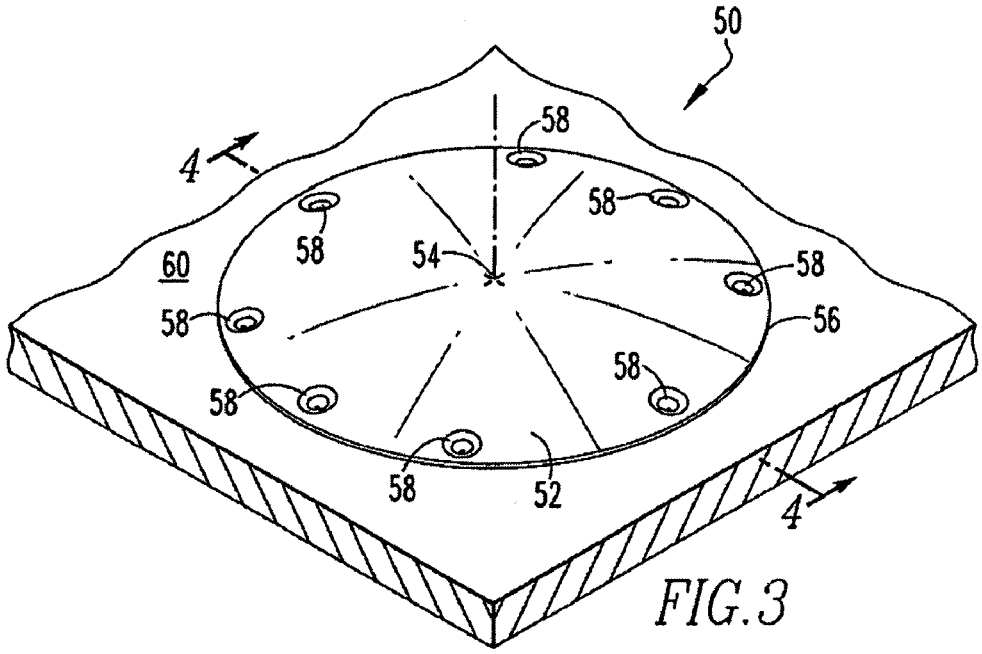
FIG. 3 is a perspective view of the top of an embodiment of a dome assembly disposed on a support structure in accordance with the disclosed and claimed concept.
Figure 4:
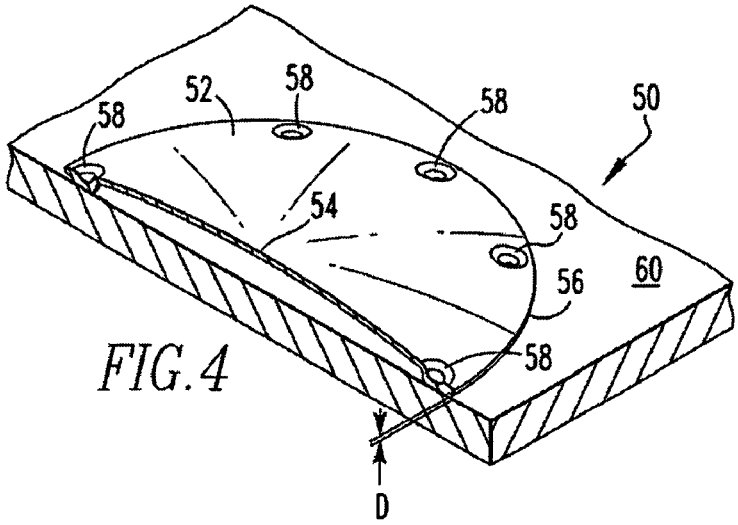
FIG. 4 is a perspective view of the embodiment of FIG. 3 with a section removed along line 4-4 to show detail.
Figure 5:
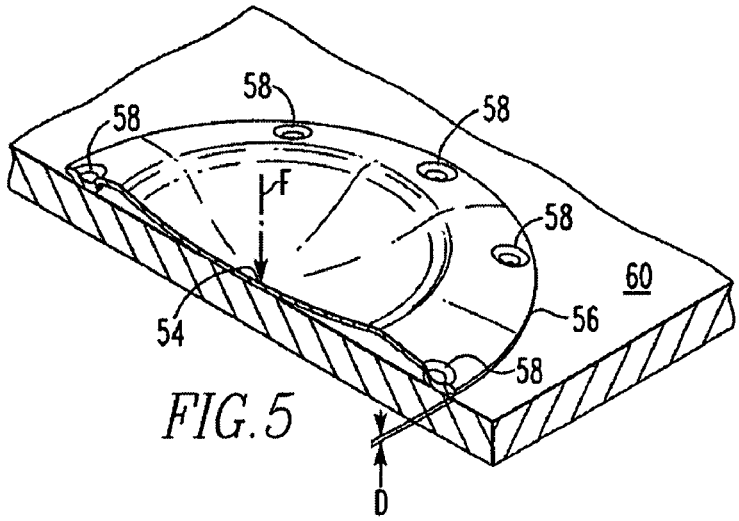
FIG. 5 is the perspective view of FIG. 4 showing the dome assembly displaced in a second position.

Underlying each of the plurality of keys 26 is a deformable dome assembly 50 such as shown in FIGS. 3-5. The dome assembly 50 includes a dome shaped resilient element 52 having a preferably centrally located apex 54 and extending to a periphery 56. Preferably, resilient element 52 is formed from stainless steel coated with a conductive layer of silver plating after forming. For low end (low cost) devices, there is no post plating process on the metal dome. It is to be appreciated that resilient element 52 may also be formed from other resilient materials, such as, but not limited to, a plastic film coated with a layer of conductive carbon material.

Referring to FIGS. 3-5, the dome assembly 50 further includes a number of elevating members 58 disposed adjacent the periphery 56 which serve to raise the periphery 56 of the resilient element 52 a distance D (see FIGS. 4 and 5) from a mounting surface 60 on which the dome assembly 50 is disposed. In a specific application of the present concept, the distance D which the periphery 56 of the resilient element 52 is raised above the mounting surface 60 is in the range of approximately 0.03 to 0.07 mm. However, such distance D may be of greater or lesser value depending on the application, more specifically the relative size and shape of the resilient element 52. Although the example shown in FIGS. 3-5 shows a dome assembly 50 having eight elevating members 58 equally spaced along the periphery, it is to be appreciated that the number and spacing of such elevating members 58 may be varied.

Figure 11:
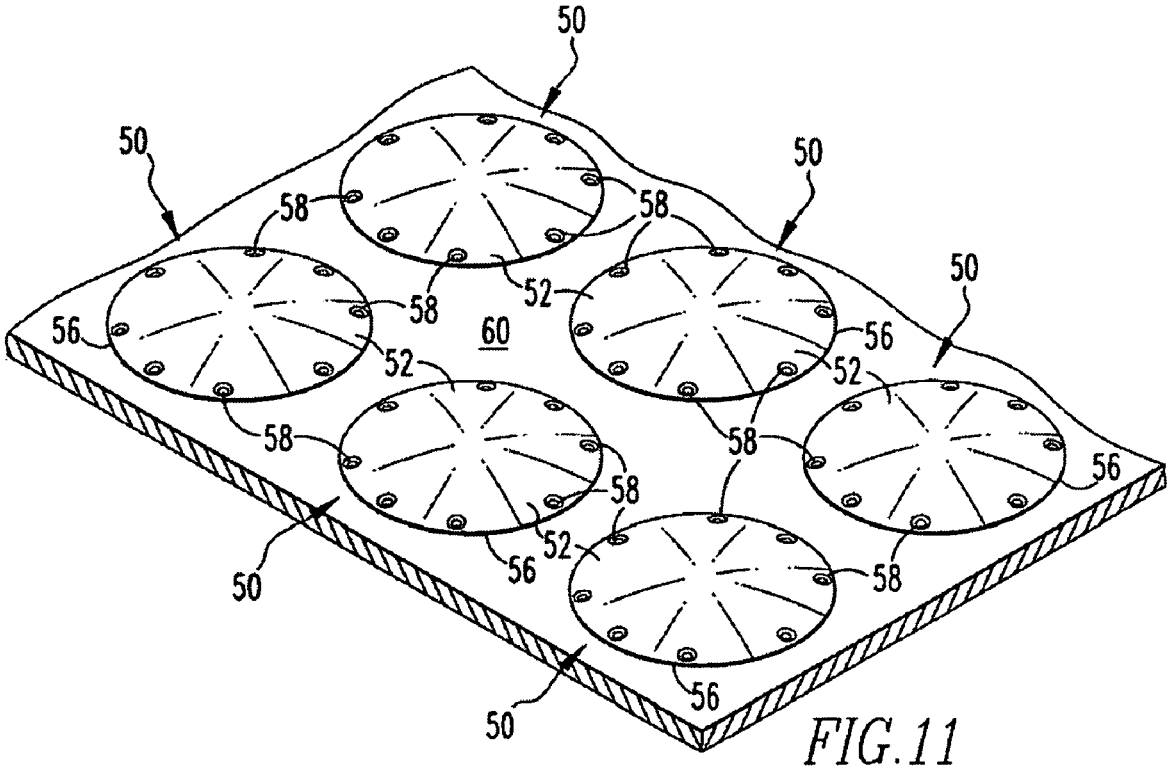
FIG. 11 is a perspective view of a portion of a keyboard assembly in accordance with the disclosed and claimed concept.

In an application such as a handheld electronic device 4 such as shown in FIG. 1, the mounting surface 60 may be a surface of a printed circuit board or other support formed from, or coupled to a portion of the housing 6 or other similar structure. In other example embodiments, such as, but not limited to, a keyboard or similar device separated from a main housing 6, mounting surface 60 may be formed from a second housing or other member formed from, or coupled to a portion of the second housing. FIG. 11 shows a portion of an example keyboard assembly including a number of dome assemblies 50.

In the example embodiment shown in FIGS. 3-5, elevating members 58 are embossments of dimple-like shape, integrally formed from the resilient element 52. Formation of such integral elevating members 58 may be carried out by stamping or other equivalent techniques. It is noted that although elevating members 58 shown in the example embodiment of FIGS. 3-5 are integrally formed with resilient element 52, such members 58 could also be separately formed and then coupled to resilient element 52. Additionally, such elevating members 58 could be coupled outside the resilient element 52 adjacent the periphery thereof while still providing the benefits of the present concept. It is to be appreciated that elevating members 58 may be of a variety of shapes including, but not limited to dimple shaped (see FIGS. 3-7), elongated dimple or groove (see FIGS. 8 and 9), cone shaped, cylindrical, or micro solid packs.

As shown in FIG. 5, when one of the keys 26 of keypad 20 is actuated, a force F is applied preferably at or near the apex 54 of dome shaped resilient element 52 causing the dome assembly 50 to collapse from its initial relaxed position as shown in FIGS. 3-4 to a collapsed position as shown in FIG. 5. In an application where the dome assembly 50 is disposed on a printed circuit board, the collapsed resilient element 52, being constructed from, or coated with a conductive material will electrically engage one or more electrical contacts (not shown) disposed on the underlying printed circuit board to complete a circuit or at least a portion of a circuit. Alternatively, collapse of the resilient member 52 may cause a portion of a circuit to open. In either case, opening/closing of at least a portion of a circuit due to collapse of the resilient element 52 results in an input to the processor 36 of the handheld electronic device 4. Upon deforming to the collapsed position, resilient element 52 produces a tactile feedback to a user of the handheld electronic device 4 thus providing the user with an indication that an input has been completed. Upon removal of the applied force F, the dome shaped resilient element 52 returns to its initial relaxed position as depicted in FIGS. 3-4.

The addition of elevating members 58 to the resilient element 52 has been found to produce the desirable attribute of enhancing the tactile feedback to a user of the device compared to the use of a resilient element lacking such elevating members 58 in which the periphery 56 is directly disposed on a mounting surface 60. Such improved tactile feedback can be attributed to a number of characteristics of the present concept. By elevating the periphery 56 of resilient element 52 from the mounting surface 60, a greater travel distance (not numbered) for a depressed key 26, and correspondingly for the apex 54 of the dome shaped resilient element 52 is provided when the resilient element 52 is moved from a non-collapsed position (FIGS. 3-4) to a collapsed position (FIG. 5).

The increase in travel distance of the apex 54 allows for the resilient element 52 to become more collapsed than a resilient element 52 with a periphery 56 disposed directly on a mounting surface 60. Also, use of the elevating members 58 allows for utilization of a resilient element 52 requiring a smaller footprint than what would be required of a dome element 52 disposed directly on the mounting surface 60 if a specific key depression distance (generally equivalent to the distance traveled by the apex 54 upon collapsing of dome element 52) is desired.

Reduction of such footprint without decreasing the key depression distance makes the present concept readily adaptable to reduced keypad applications commonly found in handheld electronic devices. Additionally, elevation of the periphery 56 above the mounting surface 60 through the use of elevating members 58 provides improved venting of air from beneath the resilient element 52 upon collapse as well as an improved path for air to return when the resilient element 52 returns to the relaxed position. When the air beneath the dome assembly 50 does not have adequate venting for evacuation or return, such as when the periphery 56 is directly disposed on the mounting surface 60, tactile feedback response is hindered and not as smooth as the case with the elevated periphery 56.

Addition of elevating members 58 to the resilient element 52 has also been found to increase the area of the dome assembly 50 to which a force F may be applied to readily collapse the dome. Increase of such area is desirable by lessoning the potential negative effects of off center actuations or slight misalignments of overlying structures which would tend to not fully collapse the dome and thus not properly register an input.

Figure 10:
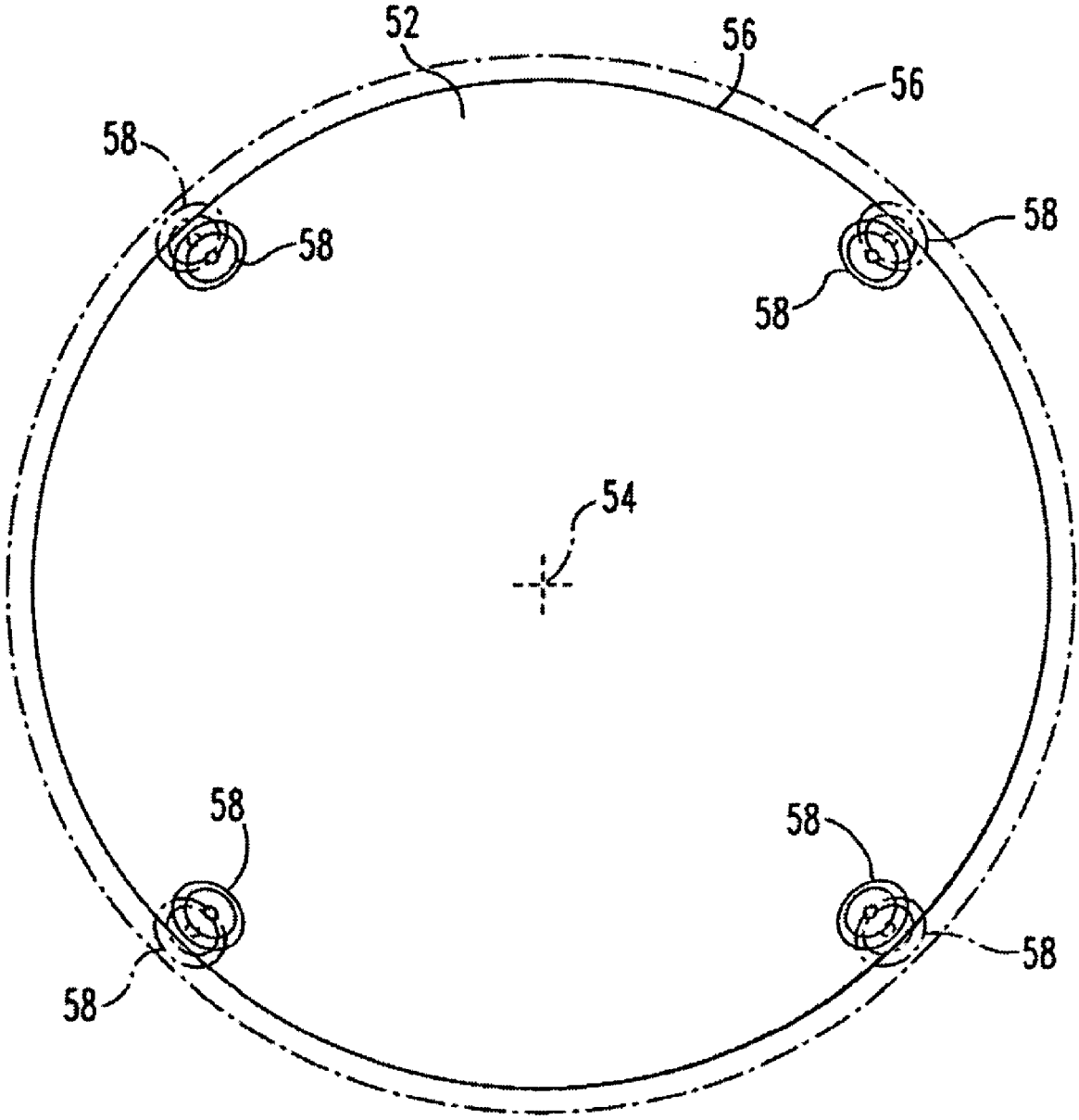
FIG. 10 is a top view of an embodiment of a dome assembly in accordance with the disclosed and claimed concept.

Use of the elevating members 58 may also provide for reduced constraint of the periphery 56 relative to the underlying mounting surface 60 which in turn reduces the frictional forces acting against dome collapse, thus providing for a more readily collapsible dome. Such reduced constraint may occur by utilizing elevating members 58 that slightly flex outward as the resilient element 52 transitions from the non-collapsed to collapsed position. Such flexure of the elevating members 58 may result in movement of at least a portion of the periphery 56 relative to the mounting surface 60. FIG. 10 shows a top view of a dome assembly 50 in which such elevating members 58 that slightly flex are employed. Referring to FIG. 10, the solid line shows the position of the periphery 56 when the resilient dome element 52 is in a non-collapsed position, and the phantom line portion shows the flexed position of the periphery 56 when the resilient dome element 52 is collapsed. It is to be appreciated that the movement of the periphery 56 as well as elevating member 58 as shown in FIG. 10 has been shown for example purposes only as the amount of such potential movement would vary depending on the structure of the particular elevating members 58 and resilient element 52.

Figure 6:
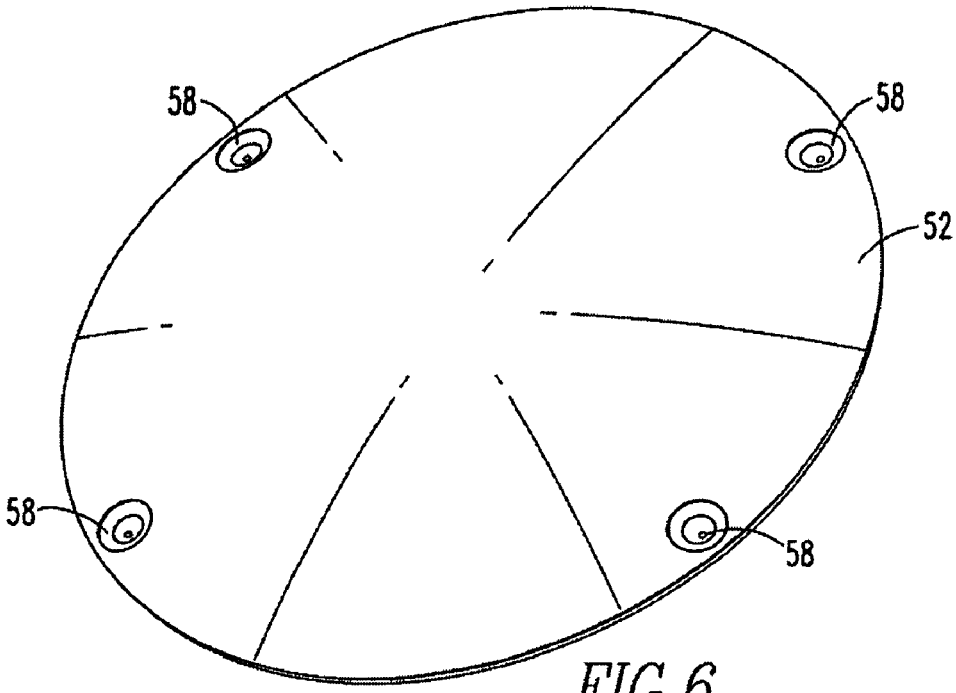
FIGS. 6-8 are perspective views of alternate embodiments of a dome assembly in accordance with the disclosed and claimed concept.
Figure 7:
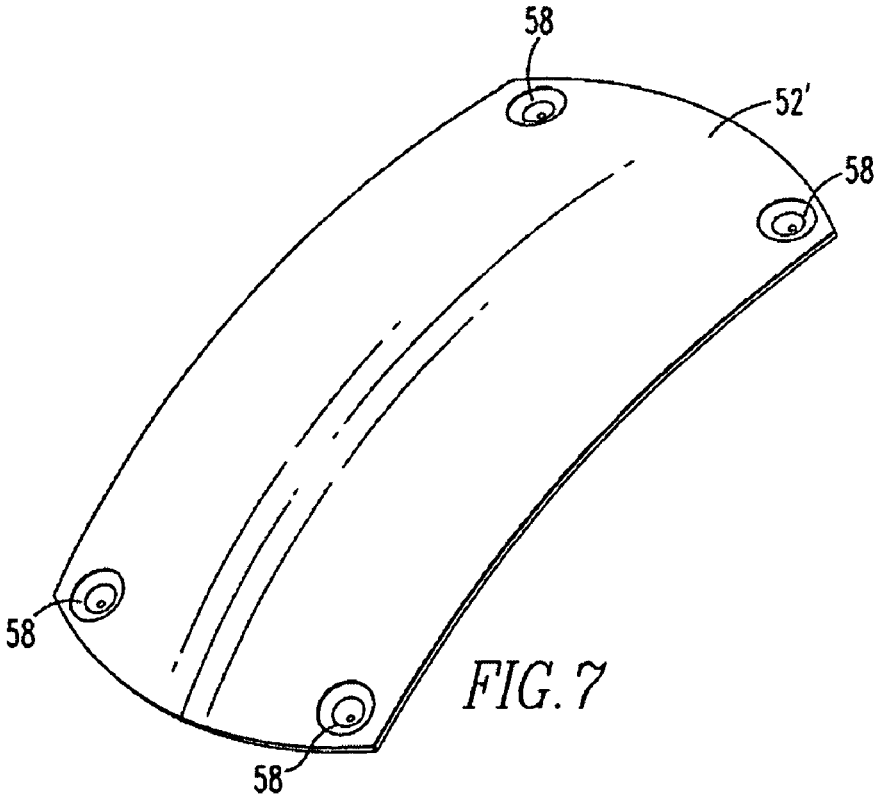

FIGS. 6 and 7 show additional example embodiments of the present concept which demonstrate potential variations on the number of elevating members 58 utilized and also variations to the shape of the resilient element 52. In particular, FIG. 6 shows an embodiment having half as many elevating members 58 as the example embodiment shown in FIGS. 3-5. FIG. 7 shows an embodiment using the same number of elevating members 58 as the embodiment of FIG. 6 but instead utilizing only a portion of a resilient element 52'.

Figure 8:
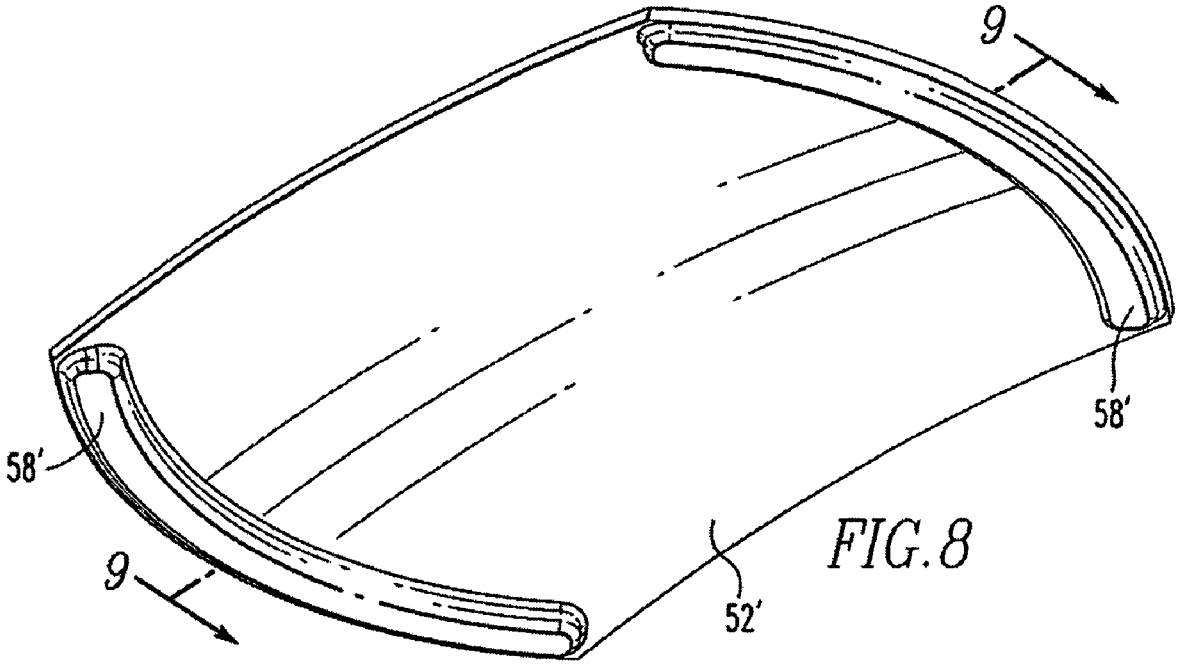
Figure 9:
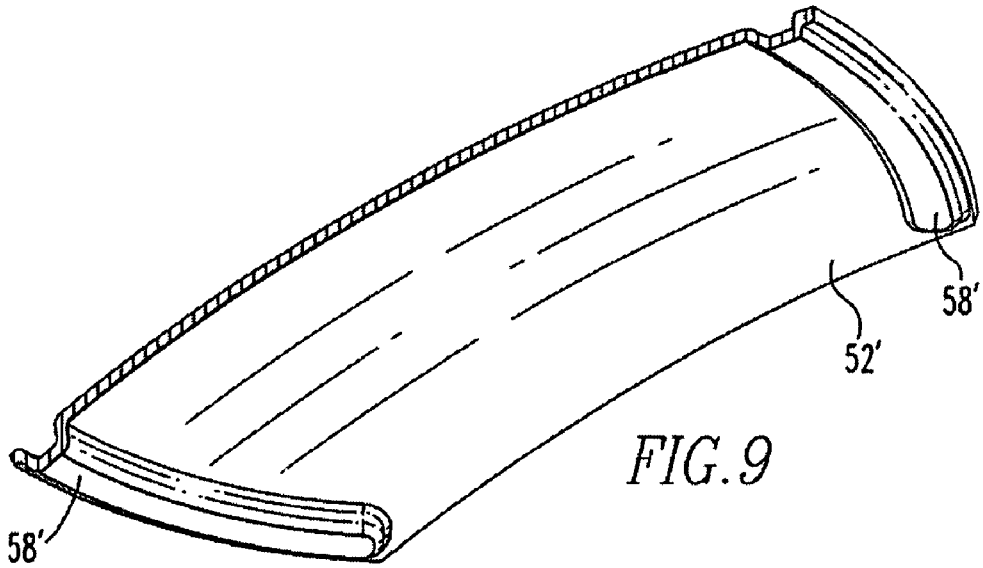
FIG. 9 is a perspective view of the embodiment of FIG. 8 with a section removed along line 9-9 to show detail.

FIGS. 8 and 9 show a further example embodiment of the present concept in which the elevating members 58 comprise elongated dimples or grooves 58' disposed on a portion of a resilient element 52'. Although only two such grooves of approximately equal length are shown in FIGS. 8-9, it is to be appreciated that the quantity and size of the grooves as well as the dimensions of dome element 52' can be varied according to the requirements of a specific application and still produce the desirable results of the present concept.

While specific embodiments of the disclosed and claimed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed and claimed concept which is to be given the full breadth of the claims appended and any and all equivalents thereof.

What is claimed is:

1. A dome assembly for use in a keyboard assembly of an electronic device, the keyboard assembly comprising a mounting surface, the dome assembly comprising:

a deflectable dome shaped element comprising a concave surface terminating at a periphery;

a plurality of elevating members, each elevating member being disposed on the concave surface of the dome shaped element at a location inboard and spaced a distance from the periphery and protruding away from the concave surface; and the dome shaped element being movable between an undeflected position and a deflected position, the dome shaped element in the deflected position being structured to open or close a portion of a circuit in the electronic device, wherein each of the plurality of elevating members is structured to be disposed on the mounting surface when the dome shaped element is in the undeflected position.

2. The dome assembly of claim 1 wherein each elevating member has a free end opposite the dome shaped element, the free ends being disposed in a plane, at least a portion of the periphery being spaced from the plane and disposed between the plane and an apex of the dome shaped element.

3. The dome assembly of claim 2, wherein the spacing between the at least a portion periphery and the plane is generally between 0.03mm and 0.07mm.

4. The dome assembly of claim 1, wherein the elevating members comprise embossments.

5. The dome assembly of claim 4, wherein the embossments comprise micro dimples.

6. The dome assembly of claim 4, wherein the embossments comprise a u-shaped groove.

7. The dome assembly of claim 1, wherein the keyboard assembly comprises a mounting surface, and wherein the elevating members are structured such that during movement of the dome shaped element between the undeflected position and the deflected position a portion of the periphery moves relative to the mounting surface.

8. A keyboard assembly for use with a handheld electronic device, the handheld electronic device comprising a housing, a processor apparatus, and an output apparatus, said keyboard assembly comprising:

a support; and a plurality of dome assemblies disposed on said support, each of the dome assemblies comprising:

a deflectable dome shaped element comprising a concave surface terminating at a periphery;

a plurality of elevating members, each elevating member being disposed on the concave surface of the dome shaped element at a location inboard and spaced a distance from the periphery and protruding away from the concave surface; and the dome shaped element being movable between an undeflected position and a deflected position, the dome shaped element in the deflected position being structured to open or close a portion of a circuit in the electronic device, wherein each of the plurality of elevating members is disposed on said support when the dome shaped element is in the undeflected position.

9. The keyboard assembly of claim 8, wherein the elevating members are disposed to position at least a portion of the periphery a predetermined distance from the support.

10. The keyboard assembly of claim 9, wherein the predetermined distance is generally between 0.03 mm and 0.07 mm.

11. The keyboard assembly of claim 8, wherein the elevating members comprise embossments.

12. The keyboard assembly of claim 11, wherein the embossments comprise micro dimples.

13. The keyboard assembly of claim 11, wherein the embossments comprise a u-shaped groove.

14. The keyboard assembly of claim 8, wherein a portion of the periphery is displaced relative to the support when the dome shaped element is moved from the undeflected position to the deflected position.

15. A handheld electronic device comprising: a housing, a processor apparatus, an input apparatus, and an output apparatus, at least a portion of each of the processor apparatus, input apparatus, and output apparatus being disposed on the housing, at least one of the housing, the processor apparatus, the input apparatus, and the output apparatus comprising a support, the input apparatus comprising a keypad that comprises a plurality of dome assemblies, each of the dome assemblies comprising:

a deflectable dome shaped element comprising a concave surface terminating at a periphery;

a plurality of rigid elevating members, each elevating member being disposed on the concave surface of the dome shaped element at a location inboard and spaced a distance from the periphery and protruding away from the concave surface; and the dome shaped element being movable between an undeflected position and a deflected position, the dome shaped element in the deflected position opening or closing a portion of a circuit in the electronic device;

wherein each of the plurality of elevating members is disposed on said support when the dome shaped element is in the undeflected position.

16. The handheld electronic device of claim 15, wherein the elevating members are disposed to position at least a portion of the periphery a predetermined distance from the support.

17. The handheld electronic device of claim 16, wherein the predetermined distance is generally between 0.03 mm and 0.07 mm.

18. The handheld electronic device of claim 15, wherein the elevating members comprise embossments.

19. The handheld electronic device of claim 18, wherein the embossments comprise micro dimples.

20. The handheld electronic device of claim 18, wherein the embossments comprise a u-shaped groove.

* * * * *